United States Patent [19]

Kobzan

[11] 4,068,657

[45] Jan. 17, 1978

[54] CONSTANT VOLUME BUOYANCY COMPENSATION SYSTEM

[75] Inventor: John Kobzan, Glenview, Ill.

[73] Assignee: Dacor Corporation, Northfield, Ill.

[21] Appl. No.: 700,581

[22] Filed: June 28, 1976

[51] Int. Cl.[2] ..... A62B 7/00

[52] U.S. Cl. ..... 128/142 R; 128/142.2; 128/142.4; 128/145 A; 61/69 R; 114/16 E

[58] Field of Search ..... 128/142 R, 142.2, 142.3, 128/145 A, 145 R, 142.4, 204; 61/70 R, 71 R, 69 R, 69 A; 114/16 E, 125, 16 A; 9/324

[56] References Cited

U.S. PATENT DOCUMENTS

| | | | |
|---|---|---|---|
| 3,161,028 | 12/1964 | Odumetal | 114/16 E |
| 3,436,777 | 4/1969 | Greenwood | 9/342 |
| 3,716,009 | 2/1973 | Strickland | 114/16 E |
| 3,727,250 | 4/1973 | Koehn et al. | 128/142.2 |
| 3,757,719 | 9/1973 | Strickland | 114/16 E |

*Primary Examiner*—Robert W. Michell
*Assistant Examiner*—Henry J. Recla
*Attorney, Agent, or Firm*—Edmond T. Patnaude

[57] ABSTRACT

A diver's buoyancy compensator employs a constant volume chamber which is controllably pressurized with air from the diver's SCUBA tank, and water is admitted to or emitted from the tank by a manually operated valve.

9 Claims, 2 Drawing Figures

CONSTANT VOLUME BUOYANCY COMPENSATION SYSTEM

The present invention relates in general to underwater diving equipment and it relates in particular to a new and improved buoyancy compensation system for use by divers.

BACKGROUND OF THE INVENTION

Buoyancy control compensation systems as commonly used in SCUBA diving generally employ a collapsible bag carried by the diver and into which air is supplied to inflate the bag to increase the buoyancy of the diver. An inherent disadvantage of these prior art systems is the fact that unless air is supplied to or removed from the bag the buoyancy compensation provided by the bag changes as the depth of the diver changes.

In the U.S. Pat. No. 3,161,028 there is described a buoyancy compensation system employing a rigid compartment attached to the diver and to which water is supplied or removed in order to adjust the overall buoyancy of the diver. Since the volume of the compartment remains constant irrespective of changes in ambient pressure as the diver descends or ascends, the buoyancy of the compartment does not vary in relation to depth. An inherent danger in using this prior art system is that should the diver descend with the mouthpiece in his mouth, the increasing differential between the ambient pressure and the pressure in the compartment can cause serious harm to the diver. There is, therefore, a need for a constant volume buoyancy compensation system which is safe, which is relatively light in weight, and which can be manufactured and marketed at a reasonably low cost.

SUMMARY OF THE INVENTION

Briefly, in accordance with the present invention there is provided a buoyancy compensation system comprising a rigid tank having a buoyancy chamber of constant volume to which ambient water is supplied to increase the effective negative buoyancy of a diver to whom the tank is attached. A pop-off type pressure regulator valve is mounted to the tank to prevent the chamber pressure from exceeding ambient pressure by a predetermined amount of say 2 p.s.i. A hand-held unit is connected to the buoyancy tank and to the diver's source of breathing air by means of two flexible hoses and includes a manually operable valve to enable the diver to control the supply of air to the buoyancy chamber. The hand-held unit also includes an emergency mouthpiece connectable to the buoyancy chamber for oral inflation and emergency breathing. The mouthpiece is also used for releasing air from the buoyancy chamber while water is being permitted to enter the chamber to increase the negative buoyancy of the diver. In accordance with an important feature of this invention pressure responsive means is incorporated in the hand-held unit to automatically operate the manually operable valve to connect the buoyancy chamber to the diver's air source to maintain the chamber pressure within a predetermined pressure differential of say 1.5 p.s.i. below ambient pressure thereby to prevent collapsing of the buoyancy tank.

BRIEF DESCRIPTION OF THE DRAWING

Further objects and advantages and a better understanding of the present invention can be had by reference to the following detailed description, wherein.

DETAILED DESCRIPTION OF THE INVENTION

Figure 1:
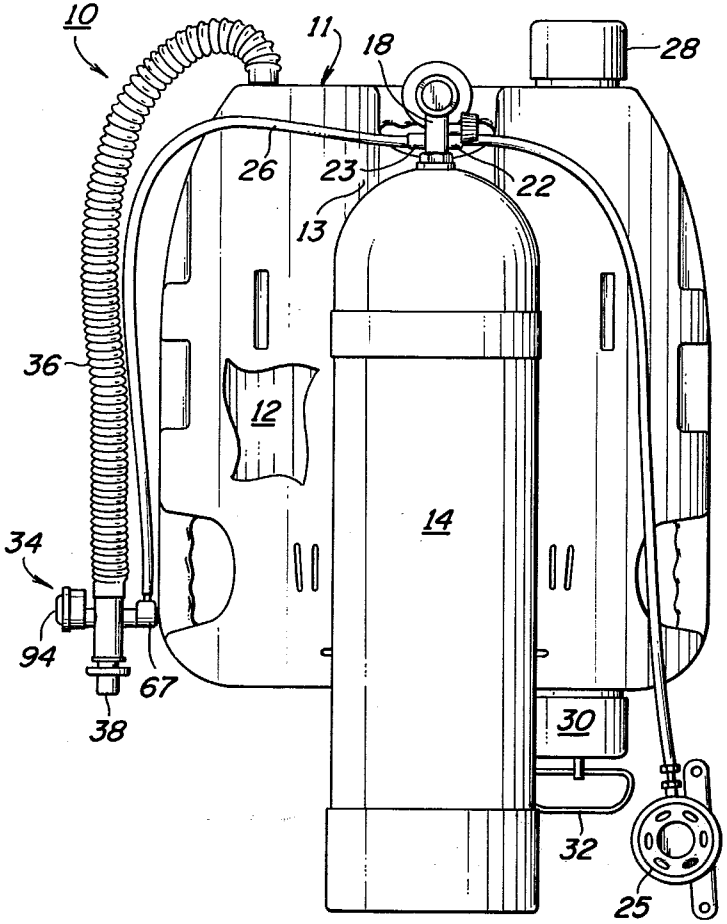
FIG. 1 is an elevational view, partly broken away, of a buoyancy compensation system embodying the present invention.

Referring now to the drawings and particularly to FIG. 1, a buoyancy compensation system 10 for use by SCUBA divers includes a hollow buoyancy tank 11 formed of a rigid plastic material such for example, as linear polyethylene, and having therein a buoyancy chamber 12 of constant volume. The rear side of the tank 11, as viewed in FIG. 1, is preferably contoured to fit the back of a diver and is contoured at the front as indicated at 13 to receive a pressure cylinder 14 containing a supply of pressured air for use by the diver in breathing underwater.

The underwater breathing system used by the diver is conventional and forms no part of the present invention. It includes a first stage pressure regulator 18 mounted to the top of the tank 14 for reducing the air pressure to 110 p.s.i. The regulator 18 as shown, has two outlet ports 22 and 23 for supplying air at this intermediate pressure to a second stage demand regulator 25 and to a flexible hose 26.

The demand regulator 25 includes a mouthpiece (not visible in the drawing) which the diver normally holds in his mouth at all times while under water. When the diver inhales, a valve in the demand regulator 25 automatically opens to supply breathing air to the diver. When the diver exhales the valve closes. As this description proceeds it will be seen that except for the use of air from the tank 14, the buoyancy compensation system of the present invention is entirely separate from the breathing system. Consequently, malfunction of one system will not adversely affect the other.

Mounted to the top of the buoyancy tank 11 is a normally closed pop-off type pressure regulator valve 28 which automatically functions to connect the top of the buoyancy chamber 12 to the ambient when the chamber pressure exceeds ambient pressure by, for example, 2 p.s.i. A spring-loaded normally closed valve 30 is mounted to the bottom of the buoyancy tank 11 and includes a bail type handle 32 connected to the valve member thereof to enable the diver to pull down on the bail to open the bottom of the chamber 12 to the ambient. Under normal conditions of use the valve 30 is opened by the diver when the buoyancy compensation is to be adjusted. This adjustment operation is more fully described hereinafter.

A hand-held countrol unit 34 is connected to the downstream end of the conduit 26, and a second flexible conduit 36 connects the control unit 34 to the top of the chamber 12. The control unit incorporates a manually operable valve for permitting the diver to increase the pressure in the buoyancy chamber 12 by interconnecting the conduits 26 and 36. Also included in the control unit is a mechanism for automatically operating the valve to supply air to the buoyancy chamber wherein the pressure therein falls below ambient pressure by a predetermined amount of say, 1 to 1.5 p.s.i. An emergency air mouthpiece 38 is provided on the control unit and when depressed opens a second valve to connect the mouthpiece to the buoyancy chamber. The mouthpiece 38 can thus be used in an emergency to breathe air from the buoyancy chamber 12 and it can also be used to permit the diver to blow air into the chamber 12.

Figure 2:
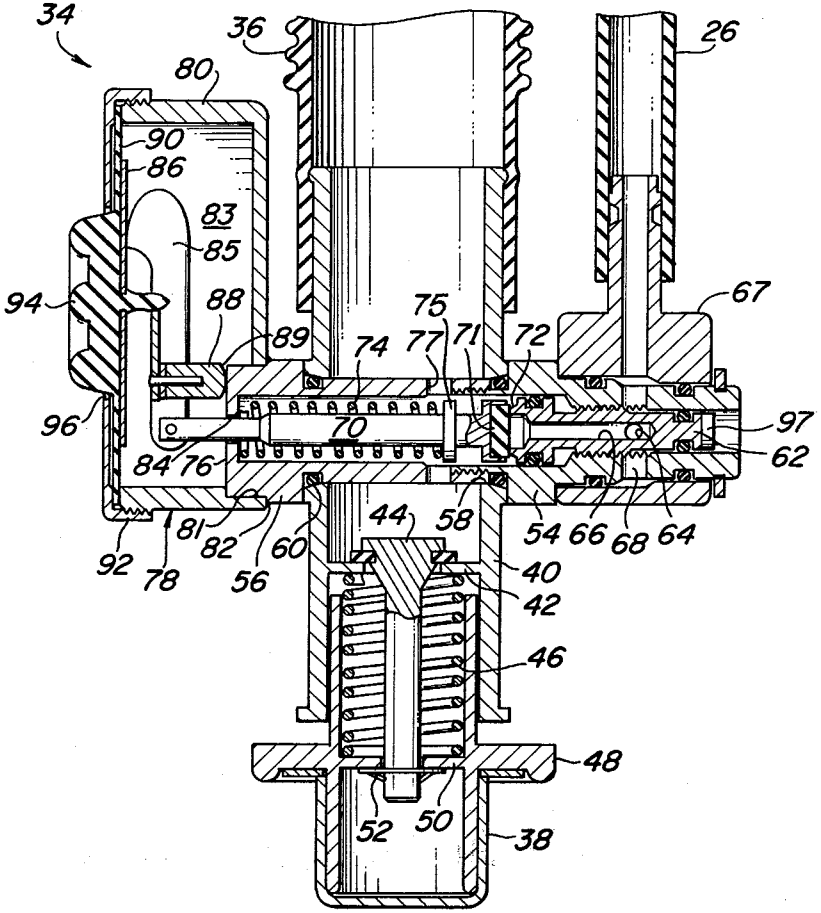
FIG. 2 is an enlarged, cross-sectional view of the hand-held control unit of the present invention, which unit is incorporated in the system of FIG. 1.

Referring now to FIG. 2 for a more detailed description of the control unit 34. As there shown, the unit 34 includes a tubular body member 40 having a centrally apertured, internally disposed transverse wall 42. The wall 42 provides the valve seat against which a valve member 44 is biased by a coil spring 46. The mouthpiece 38 is tubular and has an external annular flange 48 to facilitate depression of the mouthpiece to push the valve member 44 away from the valve seat 42. It may be seen from the drawing that the stem of the valve member 44 is attached to a partition 50 in the mouthpiece 38 by means of a spring clip 52.

A tubular valve body comprising threadedly interconnected members 54 and 56 is sealably mounted transversely of the body member 40 in diametrically opposite openings 58 and 60. A valve seat member 62 is threaded into the outer end of the body member 54 and includes a transverse hole 64 connecting to a passageway 66 therein. The tube 26 is connected to a swivel head 67 sealably journaled on the body member 54 to supply air to the passageway in the valve seat member 62 via a transverse hole 68 in the body member 54.

A valve member 70 has a sealing disc 71 mounted in the end thereof for engagement with the annular valve seat 72 provided at the end of the valve seat member 62. A coil spring 74 is compressed between an annular flange 75 on the stem of the valve member 70 and a reentrant flange 76 at the end of the valve body member 56. The spring 74 thus biases the valve member 70 into a closed position.

In order to move the valve member 70 away from the seat 72 to couple air from the conduit 26 to the conduit 36 through a transverse hole 77 in the body member 56, a valve actuator mechanism 78 is mounted over the outer end of the body member 56. The actuator 78 includes a cup-like cylindrical housing 80 having a circular opening 81 into which the outer end of the member 56 extends. These parts are fixedly and sealably secured together by means of a weld 82. The outer end of the valve member 70 extends into the chamber 83 in the housing 80 through a central opening 84 in the flange 76. A lever 85 is pinned at one end to the valve member 70 and bears at its other end against a circular plate 86. A fulcrum piece 88 has a spherical bearing surface 80 which rests against the end surface of the body member 56. A flexible diaphragm and manual operating member 90 is secured to the plate 86 and sealably held in place across the open end of the housing 80 by means of a cover 92 which is threaded onto the housing. An enlarged central section 94 of the diaphragm 90 protrudes through a central circular opening 96 in the cover 92. It may thus be seen that the valve spring 74 urges the lever in a counterclockwise direction as viewed in FIG. 2. It should also be noted that the diameter of the opening 84 is substantially larger than the diameter of the adjacent portion of the valve stem whereby the pressure in the buoyancy chamber 12 is coupled to the actuator chamber 83. The valve seat member 62 has a screw driver slot 97 at the top to permit adjustment of the force required to move the valve member 70 away from the valve seat. Preferably the seat member 62 is adjusted so that an external pressure on the diaphragm which exceeds the pressure in the buoyancy chamber 12 by between 1 and 1.5 p.s.i., will cause the valve to open and thereby to interconnect the conduits 26 and 30 to increase the pressure in the buoyancy tank.

OPERATION

In using the system 10, before descending but while in the water, the diver will open the mouthpiece valve 44 and the water valve 30 to permit water to enter the buoyancy chamber until the desired amount of buoyancy compensation is achieved. He then releases both valves and preferably depresses the diaphragm 90 by exerting thumb pressure thereon. This pressurizes the buoyancy tank to the value determined by the relief valve 28 so that should the diver need to quickly increase his buoyancy he will simply open the water valve 30 to permit the pressure already in the chamber 12 to expel water therefrom.

Since the buoyancy chamber 12 has a constant volume, unless water is supplied to or removed from the chamber the buoyancy of the system will remain constant. However, the buoyancy of the diver himself, particularly if he is wearing a diving suit, will decrease as he descends in the water and the ambient pressure increases. Consequently, if neutral buoyancy is to be maintained some water will have to be released as the diver descends and this can be achieved by simply opening the water valve 30 so long as the pressure in the buoyancy chamber exceeds ambient pressure.

In order to ascend to the surface after completion of a dive, the diver will open the air inlet valve in the hand-held control unit and simultaneously open the water valve 30. The extent to which each of these valves is held open by the diver determines the rate of ascent.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. An underwater buoyancy compensation control system for use by a diver having a source of breathing air under pressure, comprising a buoyancy tank adapted to be attached to said diver, said tank having a constant volume chamber therein sealed from the ambient, a first manually operable valve connected to the bottom of said chamber for controlling the flow of ambient water into and out of said chamber, first pressure regulator valve means connected between said chamber and the ambient, said first pressure regulator valve means being responsive to the pressure differential between said chamber and the ambient for automatically connecting said chamber to the ambient when the chamber pressure exceeds ambient pressure by at least a predetermined amount, a hand-held manually controlled unit for enabling the diver to adjust the buoyancy compensation of said system, a first flexible conduit connected between said unit and said chamber, a second flexible conduit connected between said unit and said source of breathing air, a mouthpiece mounted on said unit, second pressure regulator valve means mounted in said unit for automatically connecting said first conduit to said second conduit when the ambient pressure exceeds the pressure in said chamber by at least a predetermined amount, said second pressure regulator valve means having an inlet connected to said second conduit and an outlet connected to said first conduit, manually operable means mounted on said unit for operating said second pressure regulator valve means to connect said first conduit to said second conduit, and a second manually operable valve means mounted in said unit for connecting said mouthpiece with said outlet of said second pressure regulator valve means.

2. A system according to claim 1 wherein said second pressure regulator comprises a housing having an opening therein, a diaphragm sealably mounted across said opening with the internal side of said diaphragm being in communication with said chamber through said first conduit, the external side of said diaphragm being open to the ambient, means extending outwardly from the external side of said diaphragm to enable the diver to apply an inwardly directed manual force on said diaphragm, a valve seat, a valve member, spring means biasing said valve member into sealing engagement with said valve seat, and linkage means connected between said diaphragm and said valve member for moving said valve member away from said seat in response to an inward movement of said diaphragm.

3. A system according to claim 2 wherein said linkage means comprises lever means connecting between said diaphragm and said valve member for providing a mechanical advantage between said diaphragm and said valve member.

4. A system according to claim 2 wherein said hand-held unit comprises a tubular conduit, said mouthpiece being mounted to one end of said tubular conduit, said first conduit being mounted to the other end of said tubular conduit, a tubular body mounted to and extending transversely across said tubular conduit, said valve member and said spring means being disposed in said tubular body, said second conduit being connected to one end of said tubular body, and said diaphragm being mounted at the other end of said tubular body.

5. A system according to claim 4, comprising a cup-like housing mounted to said other end of said tubular body, said diaphragm being mounted over one open end of said cup-like housing, and lever means mounted in said cup-like housing between said diaphragm and said valve member for providing a mechanical advantage between said diaphragm and said valve member.

6. A system according to claim 4 comprising a swivel connector means connecting said second conduit to said one end of said tubular body.

7. A system according to claim 1 comprising spring means biasing said manually operable valve means into a closed position.

8. An underwater buoyancy compensation system for use by a diver carrying a source of breathing air under pressure, the combination comprising an enclosure having a constant volume buoyance chamber therein sealed from the atmosphere, means for mounting said enclosure to a diver, a hand-held unit, valve means mounted in said unit and having an inlet and an outlet, said valve means including a valve member movable between a closed position wherein said inlet and outlet are sealably closed from one another and an open position wherein said inlet and said outlet are in mutual communication, spring means biasing said valve member into said closed position, a first flexible conduit connected between said buoyancy chamber and said outlet, a second flexible conduit connected between said source of breathing air and said inlet, pressure responsive means mounted in said unit for automatically moving said valve member toward said open position when the ambient pressure exceeds the pressure in said buoyancy chamber by a predetermined amount, a mouthpiece mounted on said unit, a passageway extending between said mouthpiece and said outlet, and manually operable valve means disposed in said passageway for controllably connecting said mouthpiece to said outlet.

9. A system according to claim 8 wherein said pressure responsive means includes a diaphragm which moves inwardly to move said valve member toward said open position, and means enabling the movement of said valve member toward said open position by the application of finger pressure to said diaphragm.

* * * * *